US005787874A

United States Patent [19]

Krohn et al.

[11] Patent Number: 5,787,874

[45] Date of Patent: Aug. 4, 1998

[54] GAS-FIRED CERAMIC-COOKTOP BURNER

[75] Inventors: Günter Krohn, Hemer; Wilhelm Cramer, Sundern; Helmut Diekmann, Menden, all of Germany

[73] Assignee: Cramer GmbH, Siegen, Germany

[21] Appl. No.: 579,487

[22] Filed: Dec. 27, 1995

[30] Foreign Application Priority Data

Jan. 6, 1995 [DE] Germany ..... 195 00 263.6

[51] Int. Cl.[6] ..... F24C 3/00

[52] U.S. Cl. ..... 126/39 BA; 126/39 J; 126/39 E; 431/47; 431/60; 431/74; 431/280

[58] Field of Search ..... 126/39 R, 39 BA, 126/39 J, 39 E, 39 G; 431/280, 281, 47, 44, 60, 62, 63, 258

[56] References Cited

U.S. PATENT DOCUMENTS

| | | | |
|---|---|---|---|
| 2,916,088 | 12/1959 | Beal et al. | 431/280 |
| 3,884,413 | 5/1975 | Berquist | 431/280 |
| 3,954,384 | 5/1976 | Tyler | 431/47 |
| 4,993,401 | 2/1991 | Diekmann et al. | 126/39 BA |
| 5,024,209 | 6/1991 | Schaupert | 431/62 |
| 5,099,822 | 3/1992 | Cramer | 126/39 BA |
| 5,347,982 | 9/1994 | Binzer et al. | 431/47 |

FOREIGN PATENT DOCUMENTS 0159421 10/1985 European Pat. Off. .

89 02 031.6 6/1989 Germany .

*Primary Examiner*—James C. Yeung

*Attorney, Agent, or Firm*—Herbert Dubno; Andrew M. Wilford

[57] ABSTRACT

A cooking assembly has a main burner, a pilot burner mounted in it and having a vent, a gas valve having separate main and pilot gas outlets, and a main-burner controller including a temperature sensor on the main burner, a control unit on the valve capable of varying gas output from the main gas outlet, and a capillary tube connected between the sensor and the control unit. This controller can vary gas flow from the main outlet in accordance with the temperature of the main burner as sensed by the sensor. An electrical igniter on the main burner can be energized by a switch on the valve. A pilot-burner controller connected to the switch includes a thermoelectric sensor in the pilot vent and blocks gas output from the gas outlets when insufficient heat is detected by its sensor and the switch is not closed. When a control knob on the valve is in a closed position no gas is supplied from the outlets to the burners, in a first open position gas is supplied only from the pilot outlet to the pilot burner, in a second open position gas is supplied from both outlets to both burners while closing the switch, and in a third open position gas is also supplied from both outlets to both burners without closing the switch and while controlling the rate of gas flow from the main outlet to the main burner in accordance with the temperature detected by the capillary sensor.

5 Claims, 1 Drawing Sheet

GAS-FIRED CERAMIC-COOKTOP BURNER

FIELD OF THE INVENTION

The present invention relates to a cooking burner. More particularly this invention concerns a gas-fired cooking burner that is normally covered by a ceramic cooktop plate on which the cooking vessels to be heated are supported and through which the heat of the burner flame is conducted.

BACKGROUND OF THE INVENTION

In commonly owned U.S. Pat. No. 5,099,822 a cooking burner is disclosed which is gas fired and situated under a ceramic cooktop plate. This burner is provided with a glow-type igniter that is only switched on when no ionization is detected adjacent the burner, that is when there is no flame. In this manner explosions and flashbacks possible with a spark-type igniter are avoided while the service life of the igniter is extended as it is only energized part time. This arrangement also has a control system which will supply gas to and ignite a plurality of associated burners sequentially so that electric feed circuit is not burdened with simultaneously supplying current to a plurality of low-ohmage igniters.

While this system is normally quite satisfactory, housing the heat-sensitive electronic control components in a stove is difficult, requiring substantial insulation and other heat-protective means. The sensitive electronic components must be shielded at all costs from the frequently high temperatures of the stove.

OBJECTS OF THE INVENTION

It is therefore an object of the present invention to provide an improved gas-fired ceramic-plate burner.

Another object is the provision of such an improved gas-fired ceramic-plate burner which overcomes the above-given disadvantages, that is which needs no electronic control elements of any significant sensitivity yet which works at least as well as the prior-art systems.

SUMMARY OF THE INVENTION

A cooking assembly has according to the invention a main burner, a pilot burner mounted in the main burner and having a pilot vent, a gas valve having separate main and pilot gas outlets respectively connected to the main and pilot burners, and a main-burner controller including a capillary-type temperature sensor on the main burner, a control unit on the valve capable of varying gas output from the main gas outlet, and a capillary tube connected between the sensor and the control unit. This controller varies the gas flow from the main gas outlet to the main burner in accordance with the temperature of the main burner as sensed by the sensor. An electrical igniter on the main burner can be energized by a switch on the valve. A pilot-burner controller means connected to the switch includes a thermoelectric sensor in the pilot vent and a control unit on the valve for blocking gas output from the gas outlets when insufficient heat is detected by the sensor and the switch is not closed. When a control knob on the valve is in a closed position no gas is supplied from the outlets to the burners, in a first open position gas is supplied only from the pilot outlet to the pilot burner, in a second open position gas is supplied from both outlets to both burners while closing the switch, and in a third open position gas is also supplied from both outlets to both burners without closing the switch and while controlling the rate of gas flow from the main outlet to the main burner in accordance with the temperature detected by the capillary sensor.

While a thermostatic gas valve with a control element, normally a knob, and two gas outlets is known, one has never been used in this manner, that is instead of an electronic control system in a ceramic-cooktop range. The capillary sensor mechanically acts on the valve and does not need heat shielding. The thermoelement produces a current based on temperature which is fed to a magnetic coil and used control a spindle of the valve.

As mentioned above, the burner assembly of this invention is used under a cooktop formed by a ceramic plate immediately above both burners. The igniter is of the glow type and the main burner is annular and surrounds the pilot burner with the pilot vent extending through the main burner.

In addition according to the invention a timer unit is provided that inhibits movement of the valve from the closed position to any of the open positions for a predetermined time after movement into the closed position. Thus if the valve is moved to the closed position, it cannot be moved immediately back to the open position until the sensors have had some time to cool off. Otherwise the sensors on the still hot burner would effectively report back to the valve that there was a flame present.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
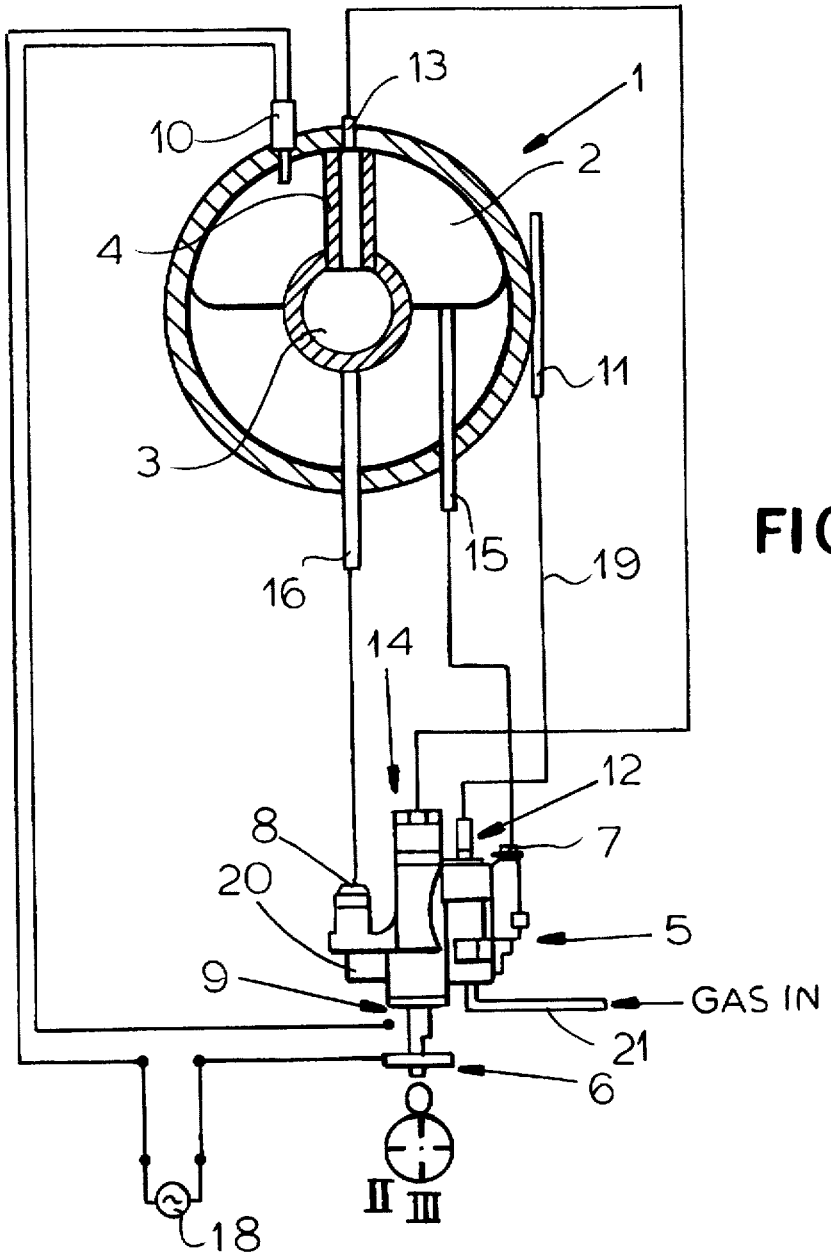
FIG. 1 is a top view of the burner assembly according to this invention.
Figure 2:
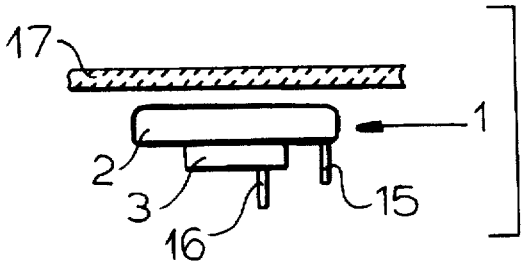
FIG. 2 is a side view of the burner.

As seen in the drawing a burner assembly 1 normally situated under a zone of a ceramic cooktop plate 17 with a plurality of other such burner assemblies 1 has a ring-type main burner 2 provided with a gas-inlet conduit 15 and a central pilot burner 3 having its own gas-inlet conduit 16 and a radially horizontally extending vent 4. The pilot burner 3 is of much smaller capacity than the main burner 2 and serves principally to maintain the burner 2 lit while providing a certain minimum heat. The larger main burner 2 is adjusted to conduct the desired amount of heat through the plate 17 to a cooking pot or the like sitting atop it.

The burners 2 and 3 are both controlled by a main gas valve 5 supplied with a combustible gas at 21 and having a control knob 6 and outlets 7 and 8 respectively connected to the conduits 15 and 16. A switch 9 can be closed by pressing the knob 6 to supply electricity from a source 18 to a glow-type igniter 10 mounted in the main outer burner 2.

In addition the burner assembly 1 is provided with a standard heat sensor 11 on the main burner 2. This sensor 11 is of the type having a liquid-filled capillary tube 19 connected to a controller 12 on the valve 5 and providing an output used to prevent the burner 2 from overheating the plate 17 and to maintain the burner 2 at whatever temperature the user selects in position III as described below.

The pilot-burner vent 4 is provided with a thermoelectric sensor element 13 connected to a thermoelectric monitoring device 14 on the valve 5. This device 14 can shut down the whole valve 5 if it detects insufficient heat in the vent 4, indicating that the burners 2 and 3 are both extinguished.

The valve described above operates as follows:

In position O (closed) of the valve gas flow from the outlets 7 and 8 to the burners 2 and 3 is shut off. The burner assembly 1 is in theory cold.

When the knob 6 is moved to position II (ignition) gas is supplied to both burners 2 and 3 via the respective inlets 15 and 16. Pressing the knob 6 in at the same time closes the switch 9 and supplies electrical current to the igniter 10, igniting the gas exiting from the burner 2 which in turn ignites the gas exiting from the burner 3.

After about 10 sec to 15 sec the element 13 is heated sufficiently that the knob 6 can be released to open the switch 9 but by this time the monitoring device 14, which has sensed via the element 13 that the burners 2 and 3 are ignited, allows the gas flow from the outlets 7 and 8 to continue.

The valve knob 6 is them moved to position III (normal use) in which the valve 5 allows the flame of the burner 2 to be varied. This is typically done by means of the knob 6 with the sensor 11 supplying feedback about the actual heat of the burner 2. In fact positions II and III can simply be end positions representing maximum- and minimum-flame positions with incremental increase or decrease in flame as the knob 6 is moved between these positions.

In position I (pilot only) of the valve 5 no gas is supplied from the outlet 7 to the main burner 2. Instead only the pilot burner 3 is allowed to burn, maintaining minimal heat and ready to ignite the main burner 2 if that is turned on.

The valve 5 is also provided with a mechanical timer unit 20 that prevents it from being moved out of position 0 for at least about 60 sec after being moved into this position. This timer 20 ensures that the burner assembly 1 will have had time to cool down, in particular the sensor 13, before gas is supplied to it again. Otherwise the safety unit 14 would allow the valve 5 to supply gas, thinking that the burner was ignited when actually it was not so that a subsequent actuation of the switch 9 could cause an explosion.

We claim:

1. A cooking assembly comprising:

a main burner;

a pilot burner mounted in the main burner and having a pilot vent;

a gas valve having separate main and pilot gas outlets respectively connected to the main and pilot burners;

main-burner control means including a capillary-type temperature sensor on the main burner, a control unit on the valve capable of varying gas output from the main gas outlet, and a capillary tube connected between the capillary sensor and the control unit for varying the gas flow from the main gas outlet to the main burner in accordance with the temperature of the main burner as sensed by the capillary sensor;

an electrical igniter on the main burner;

means including a switch on the valve closable for supplying electrical current to the igniter;

pilot-burner control means connected to the switch and including a thermoelectric sensor in the pilot vent, and a control unit on the valve for blocking gas output from the gas outlets when insufficient heat is detected by the thermoelectric sensor and the switch is not closed; and a control element on the valve for in a closed position supplying no gas from the outlets to the burners, in a first open position supplying gas only from the pilot outlet to the pilot burner, in a second open position supplying gas from both outlets to both burners while closing the switch, and in a third open position supplying gas from both outlets to both burners without closing the switch and while controlling the rate of gas flow from the main outlet to the main burner in accordance with the temperature detected by the capillary sensor.

2. The cooking assembly defined in claim 1, further comprising a ceramic plate immediately above both burners.

3. The cooking assembly defined in claim 1 wherein the igniter is of the glow type.

4. The cooking assembly defined in claim 1 wherein the main burner is annular and surrounds the pilot burner, the pilot vent extending through the main burner.

5. The cooking assembly defined in claim 1 wherein the valve is provided with timer means for inhibiting movement of the valve from the closed position to any of the open positions for a predetermined time after movement into the closed position.

* * * * *